United States Patent [19]

Sully

[11] 4,170,014

[45] Oct. 2, 1979

[54] ANTENNA COIL

[75] Inventor: George R. Sully, Waseca, Minn.

[73] Assignee: Antenna and Vehicular Accessories, Inc., Waseca, Minn.

[21] Appl. No.: 874,321

[22] Filed: Feb. 1, 1978

[51] Int. Cl.[2] ..... H01Q 9/00

[52] U.S. Cl. ..... 343/749; 343/861

[58] Field of Search ..... 343/715, 749, 861, 862, 343/711, 750

[56] References Cited

U.S. PATENT DOCUMENTS

| | | | |
|---|---|---|---|
| 3,166,751 | 1/1965 | Roll | 343/749 |
| 3,267,476 | 8/1966 | Finke | 343/861 |
| 3,461,455 | 8/1969 | Rowe | 343/749 |
| 3,513,472 | 5/1970 | Altmayer | 343/861 |
| 4,080,604 | 3/1978 | Wosniewski | 343/861 |

*Primary Examiner*—Eli Lieberman

[57] ABSTRACT

An antenna coil for use in radio frequency communications having a molded assembly of four components. The antenna coil includes a conductive top coil form insert, a conductive coil form center contact having a tap point, and a conductive bottom coil form insert disposed on a coil form inner core or placed on a removable core pin around which plastic is molded to form the antenna coil form. A plurality of grooves molded into the antenna coil form are provided to accommodate a coil wire. A whip antenna radiating element screws into a threaded inner portion of the top coil form insert and the bottom coil form insert is threaded to screw onto a base or mobile antenna mount which connects to communications equipment through a coaxial cable. The coil form center contacts has a number of alternating lugs and slots to allow a large number of coil variations. The coil form center contact accepts an insulated center pin of the base or mobile antenna mount which electrically connects to the tap point, also the feed point of the completed antenna coil. The antenna coil consists of a top series coil to compensate for a shortened length of the whip antenna radiating element and a bottom shunt coil to provide proper matching between the feed point of the antenna coil.

1 Claim, 1 Drawing Figure

ANTENNA COIL

BACKGROUND OF THE INVENTION

1. Field of the Invention

The present invention relates generally to improvements in antennas, and more particularly pertains to a new and improved antenna coil for an antenna wherein the grooved antenna coil form is molded around three or four components providing a molded grooved antenna coil form and permitting the winding of the antenna coil wire of variable number of turns forming the antenna coil.

2. Background of the Invention

Prior art antenna coils are usually composed of a number of components mechanically soldered, welded, or fitted together resulting in the antenna coil form being subjected the stresses, strains, and corrosion of the outside environment. These types of antenna coils have been unsatisfactory in that during use and service, stresses occur at the soldered, welded, or mechanical joints resulting in a structural or electrical failure of the antenna coil. Dur to mechanical vibrations in a mobile environment, it is common for some connections in mobile antenna coils to structurally break down due to the mechanical forces placed on the antenna coil in movement of the vehicle through the air or from the outside environmental conditions. Particularly, the tap point at the feed point of the antenna coil which is usually soldered, welded, etc. to the antenna coil is subject to structural breakdown between the center pin of the base or mobile mount and the antenna coil.

This invention of a grooved antenna coil permits a solid molded grooved antenna coil form having three conductive diecast pieces disposed about a coil form inner core of placed on a removable core pin, the whole assembly being molded together to provide a high strength grooved antenna coil form with a molded tap point.

SUMMARY OF THE INVENTION

The present invention obviates the foregoing disadvantages of the prior art antennas by providing a one-piece molded antenna coil form molded about and through three conductive die-cast inserts, the inserts having wire crimp lugs to permit secure electromechanical connections to a wire coil wound on the grooved antenna coil form.

According to a preferred embodiment of the present invention, there is provided an antenna coil form having a coil form inner core engaging a conductive top coil form insert, a conductive coil form center contact having a tap point, and a conductive bottom coil form insert, whereby the four components are molded together to form an antenna coil form for the antenna coil having a top series coil to compensate for the whip antenna length and bottom shunt coil between a feed point and ground to provided proper impedance matching at the feed point of the antenna.

One feature of the present invention is an antenna coil having a tap point on the conductive coil form center contact which is molded into the antenna coil form.

Having briefly described a preferred embodiment of the present invention, it is a principal object thereof to provide a new and improved antenna coil for an antenna.

An object of the present invention is to provide an antenna coil consisting of one integral molded member with grooves for the coil wire being molded into the antenna coil form.

Another object of the present invention is to provide an antenna coil having a crimp lug for the tap point, and circumferentially spaced crimp lugs for the series coil and the shunt coil with each of the lugs being molded into the antenna coil. The crimp lugs provide connection for the coil wire. Also, grooves for the coil wire are molded into the body of the antenna coil.

A further object of the present invention is to provide an antenna coil form tap point which is molded into the antenna coil. The tap point includes a crimp lug which extends outwardly from the outer surface of the grooved molded antenna coil.

Still another object of the present invention is to provide an antenna coil form which provides for changing the number of turns of either the shunt coil or the series coil of the antenna coil to adjust the antenna coil for different predetermined frequencies of operation or impedance matching respectively.

A still further object of the present invention is to provide an antenna coil which has a solid integral cover to protect the antenna coil from the outside environmental conditions.

A still additional object of the present invention is to provide an antenna coil form with circumferentially spaced crimp lugs to crimp the coil wire of the series coil and the shunt coil of the antenna coil with a mechanical crimping tool thereby not requiring soldering or welding of the coil wire to the antenna coil. This permits manufacturing of the antenna coil for optimum mechanical and electrical strength and with minimum ease.

Another additional object of the present invention is to provide an antenna coil for use in the Citizens' Radio Service, also known as CB Radio or CB Band, nearby amateur radio frequencies, or other communication frequencies.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENT

Figure 1:
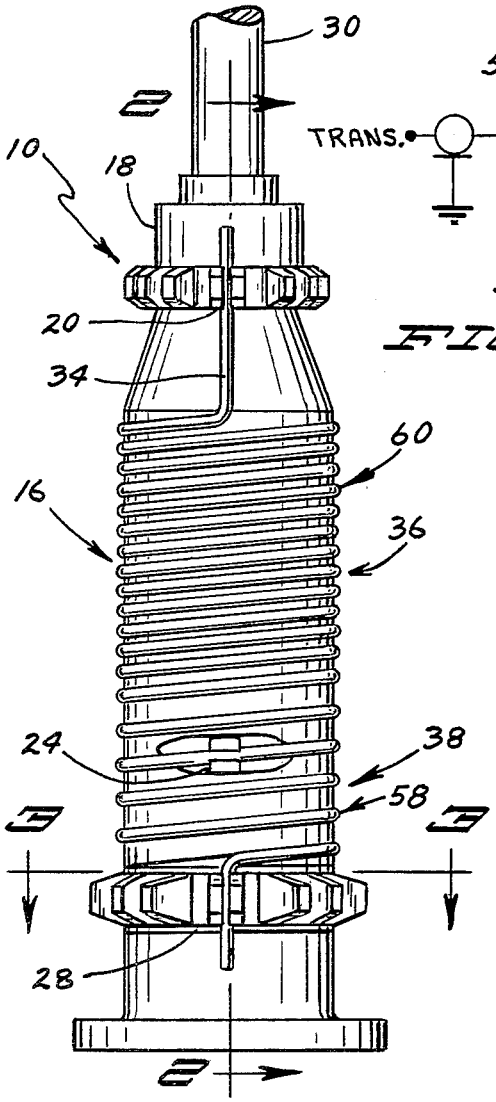
FIG. 1 illustrates a plan view of an antenna coil for an antenna.
Figure 2:
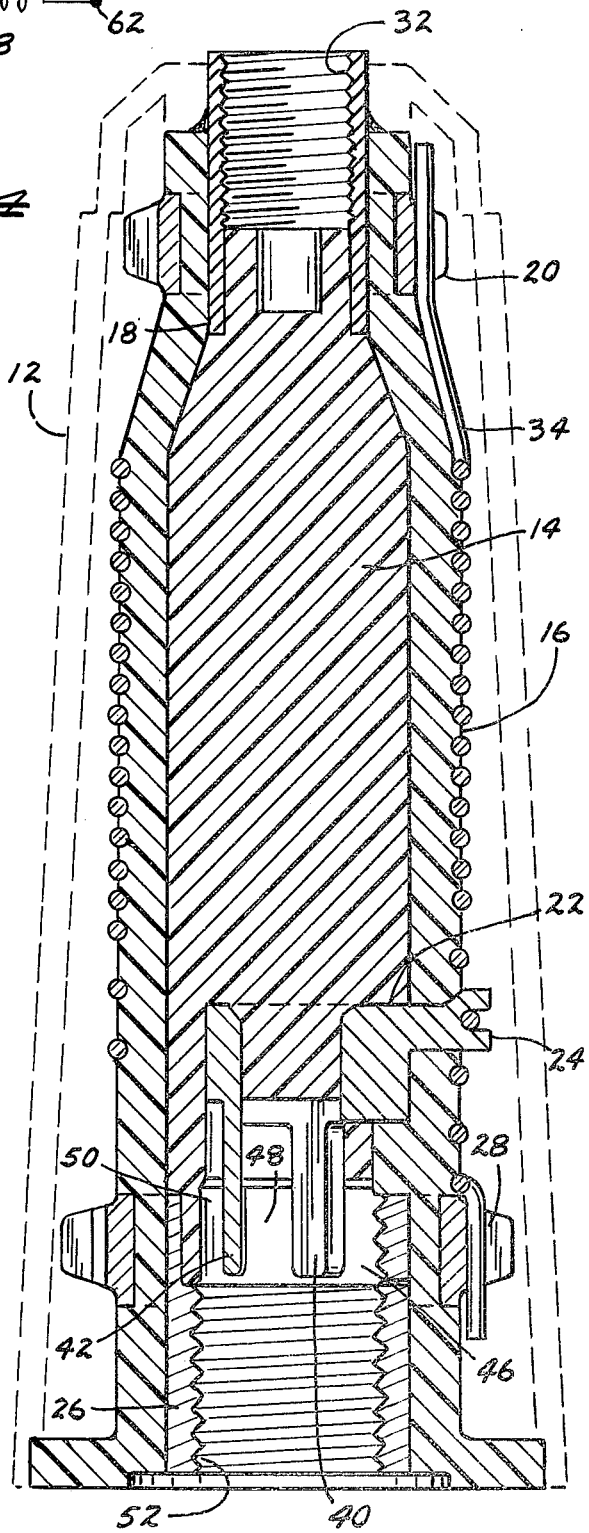
FIG. 2 illustrates a section of the antenna coil taken on line 2—2 of FIG. 1 looking in the direction of the arrows.
Figure 3:
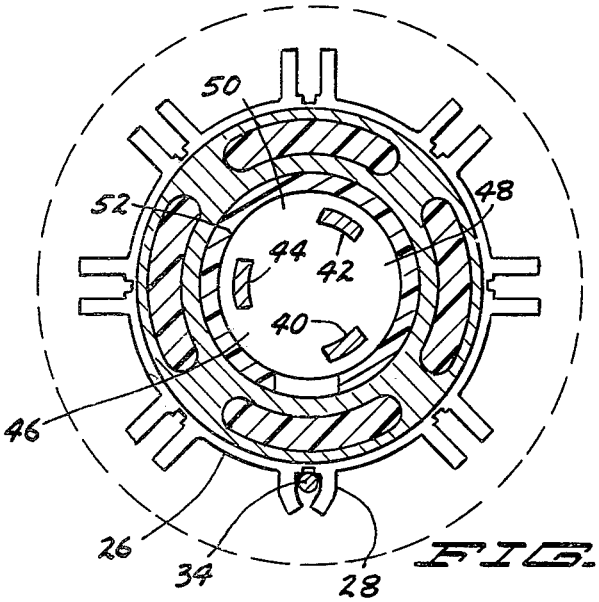
FIG. 3 illustrates a section of the antenna coil taken on line 3—3 of FIG. 1 looking in the direction of the arrows.

FIG. 1 which illustrates a plan view of a preferred embodiment of the present invention, shows an antenna coil 10 with an antenna coil cover 12 shown in imaginary lines in FIG. 2. A round central coil form inner core 14 of dielectric material, as shown in FIG. 2, supports an antenna coil form 16 consisting of a top coil form insert 18 having a plurality of circumferentially spaced and outwardly extending crimp lugs 20, a coil form center contact 22 as shown in FIG. 2 having an outwardly extending crimp lug tap point 24 at feed point of the antenna coil 10 and a bottom coil form insert 26 as shown in FIG. 2 having a plurality of circumferentially spaced and outwardly extending crimp lugs 28 with forms 18, 22, and 26 being disposed about the coil form inner core 14. A whip antenna radiating element 30 screws into a threaded inner portion 32 as shown in FIG. 2 of the top coil form insert 18. A coil wire 34 connects from one of the plurality of circumferentially spaced crimp lugs 20 of the top coil form insert 18, is wound around grooves in the antenna coil form 16, connects to the crimp lug tap point 24 of the coil form center contact 22 as shown in FIG. 2, and ends at one of the plurality of circumferentially spaced crimp lugs 28 of the bottom coil form insert 26. The top portion 36 of the antenna coil form 16 has closely spaced grooves to accommodate the coil wire 34 and the bottom portion 38 of the antenna coil form 16 has widely spaced grooves to also accommodate the coil wire 34 with a smooth transistion being made between the closely spaced grooves 36 and widely spaced grooves 38 of the antenna coil 10.

FIG. 2 illustrates a section of the antenna coil 10 taken on the like 2—2 of FIG. 1 looking in the direction of the arrows showing the coil form inner core 14 which supports the antenna coil form 16 having a plurality of grooves to accommodate the coil wire 34, the top coil form insert 18 having a plurality of circumferentially spaced crimp lugs 20, the coil form center contact 22 having a crimp lug tap point 24, and the bottom coil form insert 26 having a plurality of circumferentially spaced crimp lugs 28. Circumferentially spaced lugs and alternating slots protrude from the bottom of the coil form center contact 22 in an interior portion of the antenna coil 16. By way of example and for purposes of illustration only, three lugs with three alternating slots is a preferred number of lugs and alternating slots with lugs 40 and 47 and slots 46–50 illustrated to accommodate the center pin of a base or mobile antenna mount. The inner portion 52 of the bottom coil form insert 26 is threaded to accommodate a threaded outside portion of the base or mobile antenna mount. The lugs 40–44 with alternating slots 46–50 and the threaded inner portion 52 of the bottom coil form insert 26 accepts the antenna base or mobile mount such as a vehicle mobile mount as later described in the specification.

PREFERRED MODE OF OPERATION

The antenna coil form 16 of the antenna coil 10 is manufactured by disposing the conductive diecast top coil form insert 18 on the top of the coil form inner core 14, the coil form center contact 22 on the coil form inner core 14, and the bottom coil form insert 26 on the bottom of the coil form inner core 14. The coil form inner core 14 with the dispose conductive diecast inserts 20, 22 and 26 is loaded into a molding machine and plastic is molded around the assembly of the four components forming the antenna coil form 16 assembly having unitary structure with the clinch terminal element lugs extending outwardly and with the coil wire grooves molded into the antenna coil form 16. The grooves can be omitted from the antenna coil form 16 and are not limiting of the invention. The length of the coil form inner core 14 is determined by the frequency of operation of the antenna coil 10 and the molding machine structure which molds the antenna coil form 16 assembly of the four components 14, 18, 22 and 26.

Figure 4:
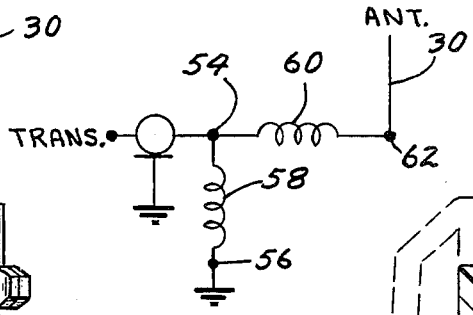
FIG. 4 illustrates an electrical schematic diagram of the antenna coil.

FIG. 4 illustrates an electrical circuit schematic diagram of the antenna coil 10. Point 54 represents an electrical connection between the inner conductor of a coaxial cable at the crimp lug tap point 24 of the coil form center contact 22 where the coil wire 34 of the feed point of the antenna coil 10 electrically connects to the inner conductor of the coaxial cable. Point 56 is ground where one end of the coil wire 34 connects to one of the plurality of crimp lugs 28 of the bottom coil form insert 24 to electrically connect the one end of the coil wire 34 to an outer conductor of the coaxial cable. Shunt coil 58 represents the widely spaced wires 36 of the antenna coil 10. Series coil 60 represents the closely spaced wires 38 on the series portion of the antenna coil 10. Point 62 represents the electrical connection of the whip antenna radiating element 30 to the series coil 60 at one of the plurality of circumferentially spaced crimp lug 20 of the top coil form insert 18 having the threaded inner portion 32 which accepts the whip antenna radiating element 30.

Depending upon the frequency of operation, a predetermined number of turns are wound around the closely spaced grooves 36 and widely spaced grooves 38 of the antenna coil form 10 thereby forming the antenna coil 10. The coil wire 34 of a predetermined number of turns is wound from one of the plurality of circumferentially spaced crimp lugs 20 of the top coil form insert 18 to the tap point 24 of the coil form center contact 22 comprising the series postion 60 of the antenna coil 10 and from the tap point 24 to one of the plurality of circumferentially spaced crimp lugs 28 of the bottom coil form insert 26 comprising the shunt portion 58 of the antenna coil 10.

In utilizing an electrically shortened antenna whip radiating element 30, the series coil 60 of the antenna coil 10 makes the antenna appear resistive and compensates for a shortened antenna whip 30 length which is usually less than a quarter wave length of the transmitting frequency. As a consequence though, a low feed point impedance of the antenna results in a mismatch between the feed point impedance and the output impedance of the communications equipment such as a transmitter. To raise the feed point impedance of the antenna, the shunt coil 58 of the antenna coil 10 is utilized to match the antenna feed point impedance to the transmitter impedance.

This particular type of antenna coil 10 lends itself to use in the ever popular Citizens' Radio Service, also known as CB Band, CB Radio, etc. In using a forty inch whip antenna 30, the series coil 60 wound between one of the plurality of the crimp lugs 20 of the top coil form insert 18 and the crimp lug tap point 24 of the coil form center contact 22 is 14 turns while the shunt coil 58 between the crimp lug tap point 24 of the coil form center contact 22 and one of the plurality of the crimp lugs 28 of the bottom coil form insert 26 is 2 and $\frac{1}{8}$ turns.

When the antenna coil 10 requires a fraction of a turn, it is necessary to start winding the coil wire 34 by drilling directly through the antenna coil form 16 to start the winding of the fraction of the turn. The coil wire 34 is crimped in one of the plurality of circumferentially spaced lugs 20 of the top coil form insert 18, fed through the drilled hole in the antenna coil form 16 and wound towards the tap point 24 of the coil form center contact 22. The starting point of the coil wire 34 of the antenna coil 10 can be any number of grooves down from the top of the antenna coil form 16 and the ending point of the coil wire 34 of the antenna coil 10 can be any number of grooves past the tap point 24.

In operation, the exact number of turns of the coil wire 34 of the antenna coil 10, being either an integer or fraction, is predetermined. The coil wire 34 is crimp in any of the plurality of spaced crimp lugs 20 of the top coil form insert 18 and any of the plurality of spaced crimp lugs 28 of the bottom coil form insert 26 to secure the coil wire 34 to the antenna coil form 16 for the desired number of turns. The crimp lug tap point 24 of the coil form center contact 22 is also crimped around the coil wire 34.

The antenna coil cover 12 is attached to the antenna coil 16 such as by glue, etc. and the antenna coil 10 is screwed onto a base mount or a mobile antenna support which are well known in the art and are manufactured in many different sizes and shapes. A whip antenna radiating element 30 of appropriate length is screwed into the inner threaded portion 32 of the op coil form insert 18. The antenna 10 is the ready for operation.

Various modifications can be made to the antenna coil of the present invention without departing from the apparent scope of the invention.

Having thus described the invention, there is claimed as new and desired to be secured by Letters Patent:

1. An antenna coil which accepts at one end an antenna mount having a connecting outer member including an insulated center pin that connects to outer and inner conductors of a coaxial cable respectively, said coaxial cable connecting to communication equipment, and accepting at the other end a radiating element, the antenna coil comprising:

a. molded plastic body;

b. conductive top coil form insert molded into one end of said plastic body;

c. conductive bottom coil form insert molded into the other end of said plastic body whereby a coil wire is wound on said molded plastic body between said top insert and said bottom insert;

d. said molded plastic body including a coil form inner core, said top coil form insert, a coil form center contact including a tap point molded into said middle portion of said plastic and alternating lugs and slots extending downwardly in an inner portion of said plastic body to accept said center insulated pin of said antenna mount, and said bottom coil form insert are disposed on said coil form, said molded plastic body further including grooves which accept said coil wire of said antenna coil, narrow spaced grooves between said top coil insert and said coil form center contact and wide spaced grooves between said coil form center contact and said bottom coil form insert whereby plastic is molded around said core, said inserts, and said contacts forming said molded plastic body said narrow spaced grooves constitute a series coil of said antenna coil compensating for a shortened radiating element and said wide spaced grooves constitute a shunt coil of the antenna coil matching the feed point of said antenna coil to said communication equipment;

e. said top and bottom coil form inserts further including a plurality of circumferentially spaced top and bottom crimp lugs extending outwardly from said molded plastic core whereby said top crimp lug electrically connects said coil wire to said radiating element and said bottom crimp lugs electrically connects said coil wire to ground;

f. said top coil form insert further including a threaded inner portion to accommodate said threated radiating element and said bottom coil form insert further including a threaded inner portion accepting said antenna mount; and, g. said coil wire is mechanically crimped in said crimp lugs of said top coil form insert, said tap point of said coil form center contact, and said bottom coil form insert, and said narrow spaced series coil comprises 14 turns and said wide spaced shunt coil comprises 2 and $\frac{1}{8}$ turns at 27 megahertz.

* * * * *